United States Patent [19]

Sigg

[11] 4,250,818

[45] Feb. 17, 1981

[54] SYSTEM UTILIZING A VIBRATORY COMBUSTION BED TO INCINERATE WASTE MATERIAL, OR FUEL

[75] Inventor: Conrad Sigg, Zurich, Switzerland

[73] Assignee: Carl Schenck AG, Darmstadt, Fed. Rep. of Germany

[21] Appl. No.: 924,688

[22] Filed: Jul. 14, 1978

[30] Foreign Application Priority Data

Jul. 14, 1977 [CH] Switzerland ..... 8836/77

[51] Int. Cl.³ ..... F23N 7/10

[52] U.S. Cl. ..... 110/278; 110/257; 110/258; 110/281; 126/170

[58] Field of Search ..... 110/258, 278, 281, 257; 126/170, 172, 176 R, 155

[56] References Cited

U.S. PATENT DOCUMENTS

| | | | |
|---|---|---|---|
| 2,499,735 | 3/1950 | Ellis | 110/278 |
| 3,473,493 | 10/1969 | Simpson | 110/258 X |
| 3,592,150 | 7/1971 | Lanyon et al. | 110/258 X |
| 3,791,316 | 2/1974 | Sigg | 110/257 |
| 3,841,242 | 10/1974 | Sigg | 110/257 |
| 3,882,803 | 5/1975 | Anderson | 110/257 |

FOREIGN PATENT DOCUMENTS 1385813 5/1975 United Kingdom .

*Primary Examiner*—Edward G. Favors

*Attorney, Agent, or Firm*—Frishauf, Holtz, Goodman & Woodward

[57] ABSTRACT

A vibration bed (1) is assembled together of a plurality of rigidly connected frames (2) extending in the feed direction (A) of the material to be burned. The frames have projecting sides (10) extending downwardly and in the feed direction. Two effectively synchronously driven vibration generator arrays (12, 13) are located on the downwardly extending projection or extensions, each one of the arrays (12, 13) has a plurality of axially serially arranged vibrators (7); preferably, every other frame has a vibrator associated therewith, and the number of frames is odd, the vibrators of one group being connected by a continuous shaft, energized by a drive from the axial ends.

1 Claim, 4 Drawing Figures

D
D
D
1
2
4
5
6
7
8
9
10
11
12
14
15
16
20
21
22
M

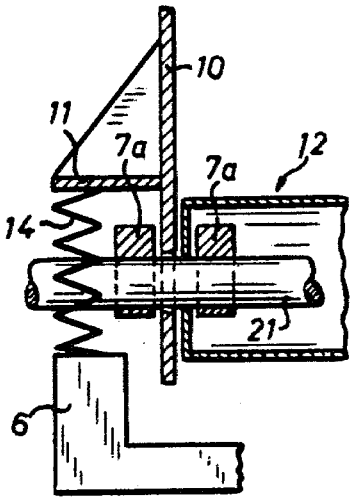
Fig. 3
Fig. 4
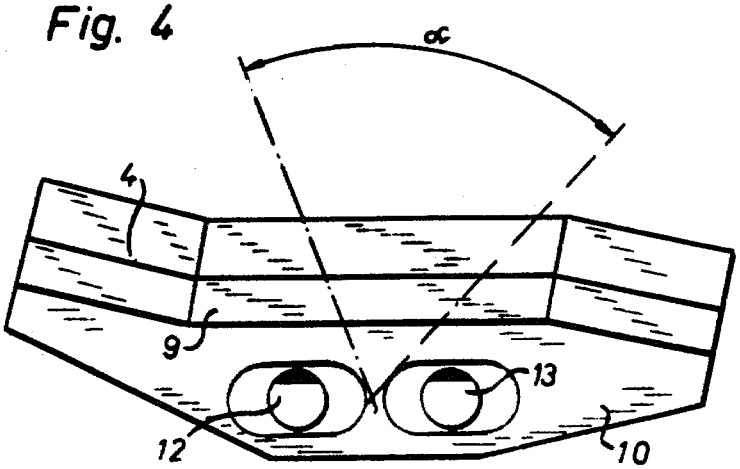

SYSTEM UTILIZING A VIBRATORY COMBUSTION BED TO INCINERATE WASTE MATERIAL, OR FUEL

The invention relates to equipment for burning substances in solid, sludge or liquid form with a vibratory combustion bed mounted on spring which contains a plurality of stepped profilesection bodies with air supply nozzles.

BACKGROUND AND PRIOR ART

In the hitherto known combustion systems of this type, the vibratory combustion bed consists of a plurality of hollow stepped profile sections which are constructed in the form of stairs and are secured to a vibratory frame, the air of combustion being supplied to the upper part of the vibratory combustion bed through the nozzle openings existing between neighboring stepped profile sections. Such systems can be improved to obtain better performance which is limited due, on the one hand, to problems of casting technology and, on the other hand, to reasons of vibration technology. A bed of the type to which this invention relates is shown in U.S. Pat. No. 3,791,316, by the inventor hereof.

THE INVENTION

It is an object to substantially eliminate the upper limit performance and, hence, to extend the advantages of these systems to large-scale plants having a relatively wide vibratory combustion bed.

Briefly, in accordance with the invention, the vibrating combustion bed comprises a plurality of mutually rigidly joined frames which extend in the direction of feed of the material being burned. Plate elements extend downwardly from the frames and are coupled, respectively, to each of a plurality of axially series connected vibrator elements, such as eccenter weights. The vibrator elements are driven synchronously by vibrator generator motors, so that the respective plates will drive the respective frames, and the bed can be substantially enlarged while still providing the desirable feed of the material to be combusted.

It is achieved thereby that substantially larger systems with the features mentioned at the outset can be construced without the arising of difficulties in regard to casting and vibration technologies. Since no mutually movable parts are present, wear too is reduced as has produced problems in conventional plants due to the high temperatures which occur.

The drawing illustrates embodiments of the subject matter of the invention.

FIG. 3 shows a diagrammatic illustration of a variant of the embodiment of the arrangement of the vibration generators;

FIG. 4 shows a part view of a vibratory combustion bed displaying varying inclinations.

Figure 1:
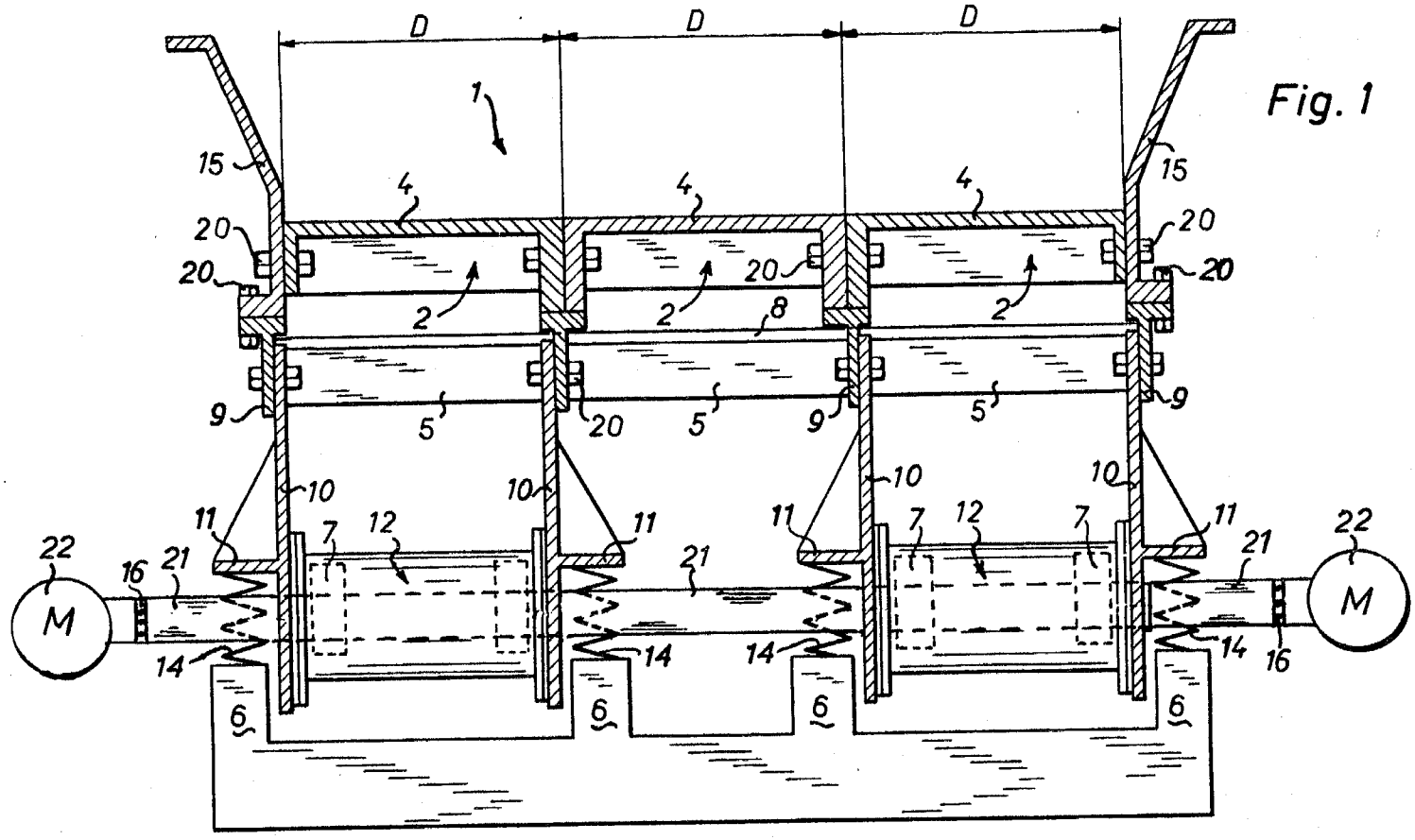
FIG. 1 shows a diagrammatic vertical section through the equipment taken on line I—I of FIG. 2.
Figure 2:
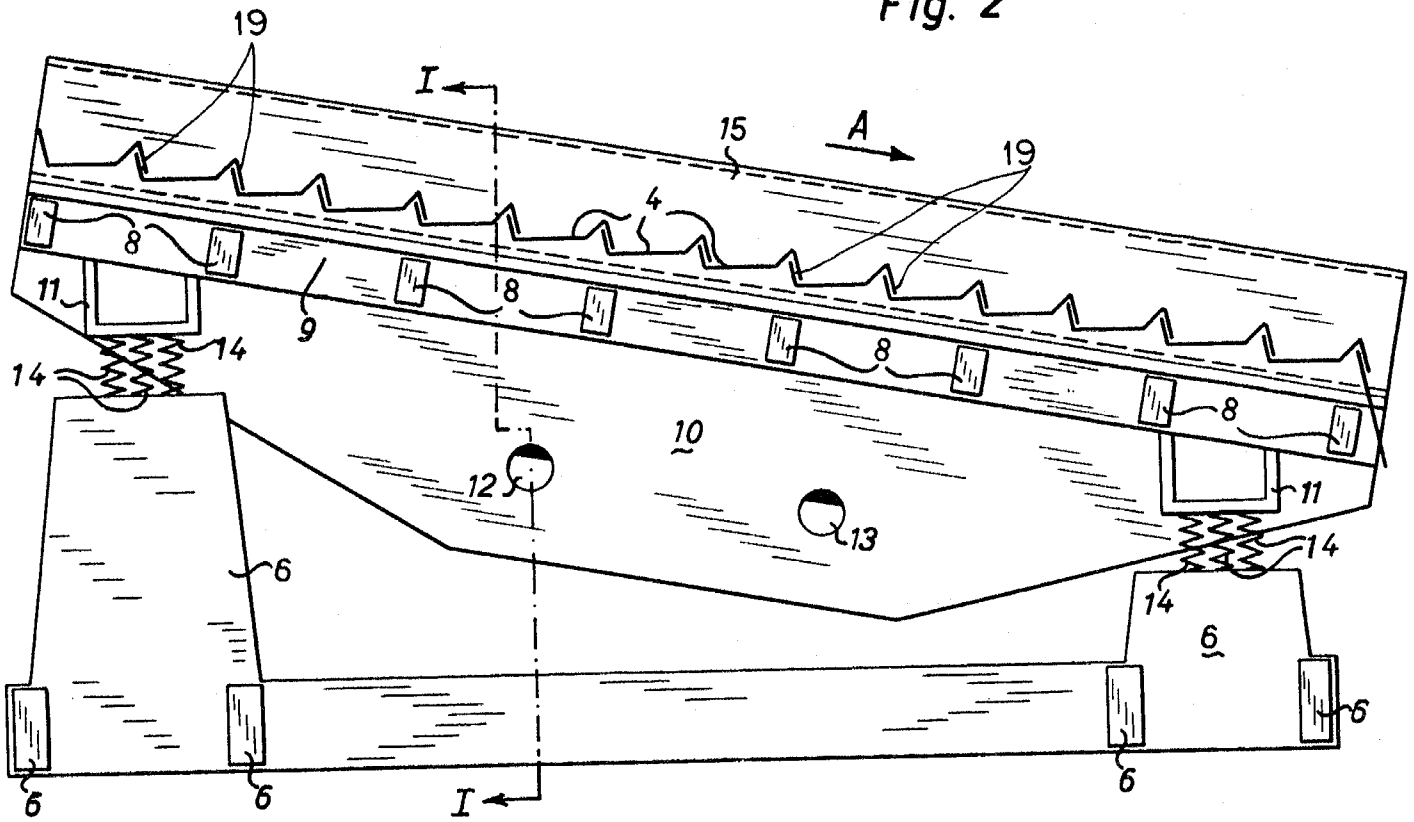
FIG. 2 shows a diagrammatic side elevation of the equipment.

The equipment illustrated in FIGS. 1 and 2 for burning waste materials with a vibratory combustion bed 1 is incorporated in a combustion furnace that is not illustrated in detail. The vibratory combustion bed contains a plurality of hollow stepped profile section bodies 4 which are arranged in the manner of stairs. The air required for the combustion is supplied from below between neighboring stepped profile section bodies 4 through air openings 19 to the material being burned, as is disclosed, for example, in U.S. Pat. No. 3,791,316, by the inventor hereof.

Such a plant can be used for burning materials in solid, pasty and liquid form, more especially refuse, sludge, residues of communal and industrial origin and also coal.

The vibratory combustion bed 1 is composed of a plurality of frames 2 which extend in the feed direction A of the material being burned. The stepped profile section bodies 4 are held rigidly on each frame 2. The individual frames 2, which are provided with cross supports 5, are joined mutually rigidly by means of bolts 20 or the like and together with the side walls 15 form the vibratory combustion bed 1.

Downwardly extending plates 10 are fixed to the frames 2 via intermediate pieces 9 and extend downwardly away from the frames 2. The intermediate pieces 9 are joined to one another by several transverse struts 8. The plates 10 are provided with base members 11 underneath against which compression springs 14 are positioned in contact with base members 11. The lower end of the compression springs 14 rests on a base frame 6.7. In the present embodiment three frames 2, each having the width D (FIG. 2) are present. Preferably the width D is about 1.4 m. A larger, odd number of such frames 2 could be present, thus enabling a grate area of more than 100 $m^2$ to be reached. The vibratory combustion bed is set to vibrate by two groups of vibrators 12, 13. Each vibrator group 12, 13 contains several vibrations actuators or rotary actuators, preferably in the form of unbalance-producing bodies 7, which are seated on a common axis 21 close to the plates 10 in each group. The drive is effected on both sides by drive motors 22 arranged outside the combustion furnace and driving the axis 21 via an elastic or articulated coupling 16. The drive of both vibrator groups 12, 13 ensues practically synchronism i.e. during the actual operation a precise synchronism is maintained and it is only for altering the vibration mode that an angular displacement of the unbalance-producing bodies is effected by electrical phase displacement of the drive motors of the one group. After the regulatory process has been carried out, the drive motors 22 of the same group once more run synchronously in the newly adjusted relative position. The direction of rotation of the two vibrator groups 12, 13 is in mutually opposite direction.

In the embodiment illustrated in FIG. 3, the pairs of unbalance-producing bodies *7a*, *7a* are arranged close to each plate 10 on both sides.

The vibration actuators are constructed in such a way that the vibrations generated lie mainly in the range of 45° to 110° to the horizontal. In FIG. 4, this range is denoted by angle $\alpha$.

The vibratory combustion bed in accordance with FIG. 4 displays a varying inclination between the inlet and outlet. The central portion is constructed to be predominantly horizontal, while the inlet and outlet are respectively inclined.

The axes of the two vibrator groups 12, 13 can lie in a horizontal plane.

I claim:

1. Equipment for burning substances in solid, sludge, or liquid form having a vibrating combustion bed (1) mounted on springs, the combustion bed including a plurality of stepped profiled sections with air supply means (19), characterized in that the vibrating combustion bed comprises a plurality of mutually rigidly joined frames (2) which extend in the direction of feed (A) of the material being combusted;

plate elements (10) extending downwardly from the frame; and at least two effectively synchronously driven vibration generator groups (12, 13) are provided, operatively connected to the plates of respectively different frames to vibrate the same, each including a plurality of axially series-connected vibrator elements (7).

2. Equipment as claimed in claim 1, characterized in that an odd number of frames (2) is present and each second frame has a vibration generator group (12, 13) associated therewith.

3. Equipment as claimed in claim 1 or 2, comprising a continuously extending shaft (21) connecting all vibrator elements (7) of a group;

and motor drive means driving the shaft from both shaft ends.

4. Equipment as claimed in claim 1 or 2, wherein two vibration generator groups (12, 13) are provided;

each vibration generator group including an electric driving motor driving individual groups, the motors driving said groups operating synchronously, and being controlled to achieve angular displacement between the groups, and hence varying vibration modes.

5. Equipment as claimed in claim 1, wherein respectively two neighboring frames (2) have a common plate element (10);

springs (14) are provided engaged on a support and on a base frame secured to the plate element;

and the vibrator elements comprise unbalance-producing bodies (7) arranged close to the plate elements.

6. Equipment as claimed in claim 1, wherein the vibrator elements comprise respective unbalance-producing weights (7) located at respectively opposite sides of the plates elements.

7. Equipment as claimed in claim 1, wherein the vibrating combustion bed has regions of different inclination.

8. Equipment as claimed in claim 1, further including struts (8) rigidly joining the frames;

and wherein each vibration generator group (12, 13) includes a plurality of axially series connected vibrator elements, and shaft means serially connecting said vibrator elements extending across the bed.

* * * * *